US007077734B2

(12) United States Patent
Tiede et al.

(10) Patent No.: US 7,077,734 B2
(45) Date of Patent: Jul. 18, 2006

(54) ECCENTRIC GRINDING HAND POWER TOOL

(75) Inventors: Steffen Tiede, Herrenberg (DE); Dieter Weninger, Steinenbronn (DE)

(73) Assignee: Robert Bosch GmbH, Stuttgart (DE)

( * ) Notice: Subject to any disclaimer, the term of this patent is extended or adjusted under 35 U.S.C. 154(b) by 16 days.

(21) Appl. No.: 10/960,729

(22) Filed: Oct. 7, 2004

(65) Prior Publication Data

US 2005/0079808 A1 Apr. 14, 2005

(30) Foreign Application Priority Data

Oct. 10, 2003 (DE) ..... 103 47 849

(51) Int. Cl.
*B24B 23/00* (2006.01)

(52) U.S. Cl. ..... 451/357; 451/359

(58) Field of Classification Search ..... 451/353, 451/357, 359, 354, 351, 350
See application file for complete search history.

(56) References Cited

U.S. PATENT DOCUMENTS 5,879,228 A 3/1999 Sun
6,190,245 B1 * 2/2001 Heidelberger et al. ..... 451/357
6,887,141 B1 * 5/2005 Lin ..... 451/357
2004/0082285 A1 * 4/2004 Bohler ..... 451/359
2005/0202767 A1 * 9/2005 Reich et al. ..... 451/456

FOREIGN PATENT DOCUMENTS

DE 36 25 671 C1 1/1988
EP 1 129 822 A1 9/2001

OTHER PUBLICATIONS

Patent Abstracts of Japan JP 2000148731 Published on May 30, 2000.

* cited by examiner

*Primary Examiner*—Jacob K. Ackun, Jr.
(74) *Attorney, Agent, or Firm*—Michael J. Striker

(57) ABSTRACT

An eccentric grinding hand power tool has a housing, a grinding plate unit supported on the housing and being eccentrically driven, an elastic seal that dust-tightly seals the housing with respect to the grinding plate unit, the elastic seal being held on the housing both in a form-locking, positive manner and in a force-transmitting, non positive manner without separate elements but with integrated securing elements.

8 Claims, 6 Drawing Sheets

ECCENTRIC GRINDING HAND POWER TOOL

BACKGROUND OF THE INVENTION

The present invention relates to an eccentric grinding hand power tool or an eccentric grinder.

Such eccentric grinder is disclosed for example in the German patent document DE 36 26 671 C1. In this eccentric grinder mounting and dismounting of a transmission seal formed as an elastic diaphragm is relatively complicated and time consuming. Since however the transmission seal is a part which is subjected to wear, it is important when necessary and as seldom as possible, to exchange it in a fast and uncomplicated manner.

SUMMARY OF THE INVENTION

Accordingly, it is an object of the present invention to provide an eccentric grinding hand power tool which is a further improvement of the existing hand power tools of this type.

More particularly, it is an object of the present invention to provide an eccentric grinding hand power tool which has the advantage that exchange of the durable and reliable transmission seal can be performed in a simple, time saving manner without a tool.

In keeping with these objects and with others which will become apparent hereinafter, one feature of the present invention resides, briefly stated, in an eccentric grinding hand power tool, comprising a housing; a grinding plate unit supported on said housing and being eccentrically driven; an elastic seal that dust-tightly seals said housing with respect to said grinding plate unit, said elastic seal being held on said housing both in a form-locking, positive manner and in a force-transmitting, non positive manner without separate securing elements, but instead with integrated securing elements.

Since the transmission seal is holdable on the housing of the hand power tool in a force-transmitting or non positive manner and also in a form-locking or positive manner, it provides an improved sealing action and is secured from undesired loosening and against joint rotation by the eccentric or the driver.

In accordance with another feature of the present invention, the edge of the transmission seal is formed as a collar which is conveniently graspable by hand. Therefore, it can be exchanged exclusively by hand in a fast and convenient manner.

In accordance with another feature of the present invention, the transmission seal is formed as a truncated corrugated membrane. Therefore, its center is actually prestressed relative to the eccentric or driver to be sealingly engaged, and the sealing action there is improved.

In accordance with still another feature of the present invention, in the center of the corrugated diaphragm, a shaft seal ring is releasably held for a joint rotation therewith and slidingly, sealingly surrounds the driver. Therefore, the transmission can be sealed in a cost favorable and efficient manner with an exchangeable standard sealing element.

In accordance with still a further feature of the present invention, the shaft seal ring is supported with low friction axially by a sliding element relative to the neighboring rotating elements. Therefore, its wear is minimized and the efficiency of the eccentric grinder is increased.

In accordance with a further feature of the present invention, an edge seal of an eccentric plate relative to the lower edge of the transmission housing closes approximately airtightly. Therefore, in connection with the corrugated membrane which seals the transmission housing from below, an especially efficient suction of grinding dust falling under the grinding plate is provided, and also its whirling-free, flow-favorable throughflow through the space between the lower side of the transmission housing and the grinding plate unit is secured and a deposit of the grinding dust there is prevented.

The corrugated diaphragm with a sealing edge on a collar of the housing cover can engage in a circumferential radial ring groove. Thereby due to the form-locking connection, it is secured against sliding away in an axial direction, and simultaneously a labyrinth seal against entry of grinding dust into the transmission housing is provided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
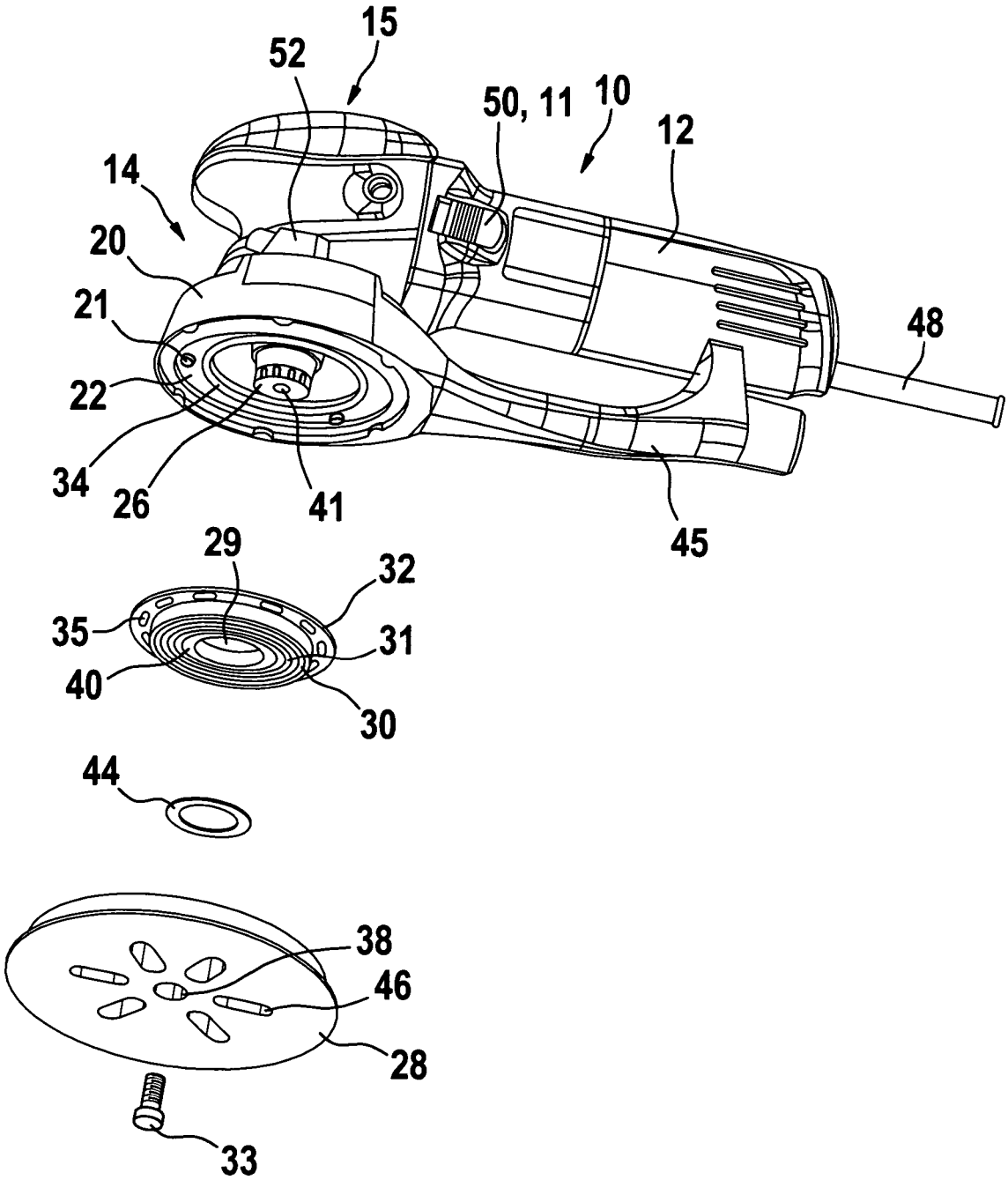
FIG. 1 is a partial explosion view of a hand power tool in accordance with the present invention.

An eccentric grinding hand power tool which is identified shortly as an eccentric grinder 10 and shown in the drawings has an elongated motor housing 12. It is connected with a rectangular, downwardly extending transmission housing 14 located at the left side of the drawing and provided for receiving an angular transmission 16, and also is connected with an eccentric transmission 18 which is wetted with a lubricant.

The transmission housing 14 has a central, stepped cylindrical core housing 19 composed of metal and a housing shell 17 which surrounds it, is composed of synthetic plastic, and provided with an upper end supporting surface 15 of soft, non skid synthetic plastic. The core housing 19 is flanged in a fluid-tight manner on a downwardly bell-shaped extending region, shortly a bell 20. The bell 20 receives the eccentric transmission 18 which is also wetted with lubricant. The circular lower side of the bell 20 is closed in a flange-like manner by a housing cover 22 to a central opening 24, by means of screws 21. The housing cover 22 supports an assembly of the eccentric transmission 18, wherein a driver 22 extends from its central opening 24 in an extension of the eccentric transmission 18. The driver 26 which is driven by an eccentric pin 72 serves for the form-locking or positive coupling with a grinding plate unit 28, for driving it in an orbital fashion, and selectively also for rotating centrally.

An elastic seal is provided between the grinding plate unit 28 and the bell 20 in form of a corrugated membrane 30. It prevents penetration of grinding dust into the interior of the bell 20 or the transmission housing 14.

The corrugated membrane 30 is formed as an elastic circular disc with a corrugated profile 11 extending concentrically from a central hole 38. With a cup-shaped outer seat 36 on its outer edge 32 it engages over an axially projecting collar 34 of the housing cover 22, both in a force-transmitting or non positive manner and in a form-locking or positive manner, since the outer seat 36 has a smaller dimension relative to the collar 34 and thereby is mountable to engage the collar 34 only pre-stressed or stretched.

The central hole 38 supports or carries an inner seat ring 39 in a sealed manner. A radial shaft sealing ring 40 is pluggable into the inner seat ring 39 in an exchangeable and sealing manner. The radial shaft sealing ring 40 surrounds the outer periphery of the driver 26 with the inner ring wall, 42 as a sliding seal in a dust-impermeable manner. The edge 32 or the collar with expansion openings 35 formed as longitudinal holes facilitates the expansion and the handling with the corrugated membrane 30 during its mounting and dismounting without tools.

A flat sliding ring 44 that serves as a lubricant depot is arranged between the corrugated membrane 30 and the grinding plate unit 28 in the region of the radial shaft sealing ring 40. The sliding ring 44 is supported on the inner seat 39 or on the radial shaft seal 40 and on the corrugated membrane 30 and protects the same from a direct contact by the grinding plate unit 28 to thereby increase service life and efficiency of the corrugated membrane 30 and thereby of the eccentric grinder 10. The protection of the radial shaft sealing ring 40 or the corrugated membrane 30 is performed from coarse dust particles and from running around on the grinding plate unit 28. The material of the sliding ring 44 has high sliding properties when compared with the material of the grinding plate or the inner ring.

Elongated dust aspiration openings 27 arranged on a concentric partial circle and a central throughgoing opening 29 for passage of a threaded pin 33 extend through the grinding plate unit 28. The threaded pin 33 engages in an inner threaded opening 41 of the driver 26 and holds the grinding plate unit 28 non releasably for joint rotation therewith.

A suction pipe 45 extends from the bell 20 radially and parallel to the motor housing 12 under it for connection with a vacuum cleaner. An electric cable 48 for a current supply of a not shown motor extends parallel to the suction pipe 45 out of the motor housing 12. In the region of the transition to the transmission housing 14, the motor housing 12 laterally carries an on/off switching key 50 for starting or stopping of the electric motor in the interior of the motor housing 12.

Figure 2:
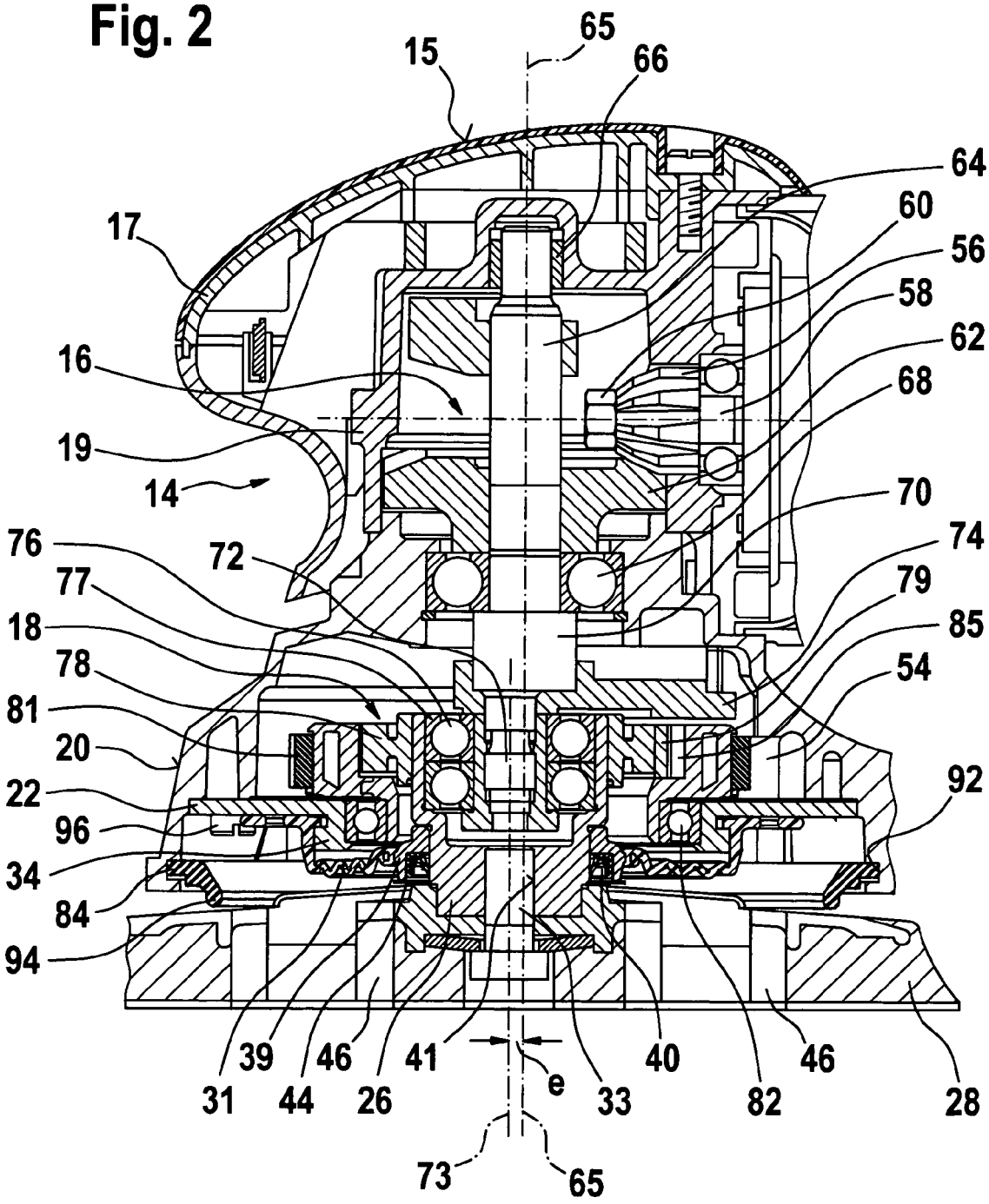
FIG. 2 is a view showing a longitudinal section of the hand power tool of the invention shown in FIG. 1.

On its upper, laterally projecting side, the bell 20 carries a switching lever 52 for switching the eccentric transmission 18 shown in FIG. 2. Depending on the switching position of the switching lever 52, the eccentric transmission 18 is transferred from a coarse processing stage to a fine processing stage or vice versa.

A hand placing surface 18 is arranged on the outer side of the transmission housing 14 and provided with a rubber soft grip. The eccentric grinder 10 can be grippable and guidable with the operator hand efficiently by means of the rubber soft grip.

FIG. 2 shows a longitudinal section of the transmission housing 14 and the bell 20 and a part of the motor housing 12 which extends to the right rearwardly as considered in the observation direction.

It can be seen that the angular transmission 16 has a conical pinion 56 which is seated for joint rotation on a motor housing shaft 58 of a not shown electric motor located in the motor housing 12. The conical pinion 56 is axially secured by a threaded nut 60 on the motor output shaft 58 and is located in a toothed engagement with a ring gear 62. The latter engages around a driven shaft 64 for joint rotation therewith. The driven shaft 64 is supported with its upper end in a needle bearing 66. Under the ring gear 62 the driven shaft 64 is supported in a ball bearing 68, that extends downwardly toward the grinding plate unit 28 with its expanded collar 70. The collar transits axially downwardly into an eccentric pin 72, whose axis 73 is offset parallel relative to the axis 65 of the driven shaft 64 by several millimeters with an eccentricity, as shown in FIG. 42.

A circular-segment-shaped compensation mass 74 is arranged at a motor side axially over the eccentric pin 72 in an abutment position to the collar 70. It provides an unbalance compensation for the concentric pins 72 and the grinding plate unit 28 or the driver 26 arranged on it. The eccentric pin 72 sits in inner rings 75 of a double roller bearing 76, whose outer rings 77 sit in the stepped cylindrical driver 26 with a spline-shaft-like free end, for joint rotation therewith. Thereby the driver 26 is supported freely rotatably relative to the eccentric pin 72 and can transfer a rotary movement performed around its axis 73 because of the bearing friction in the double roller bearing 76 and direct torque to the grinding plate unit 28.

A ring-shaped spur gear 78 engages around the driver 26 for joint rotation therewith. It must follow its eccentric movement, and with a small part of its outer teeth 79 is in a continuous engagement with a hollow gear 80. The hollow gear 80 in turn is rotatably supported on the housing cover 22 through a roller bearing 82 and is therefore arrestable with respect to the housing through an arresting jaw 54 which is releasably engageable in an outer ring 21. In the case of arresting, or the coarse processing adjustment of the eccentric transmission 18, no torque transmission through the spur gear 38 is performed and it is forcedly rolled on the hollow gear 18, while on the driver 26 and thereby on the grinding plate unit 28 an additional cycloidal movement or path component is superposed, which leads to an intense grinding material removal. To the contrary, with the released arresting jaw 24 the hollow gear 80 acts by the switching lever 52 "yieldable" so that a positive rolling of the spur gear 38 does not occur, but instead the hollow gear 80, with a certain delay, rotates together with the spur gear 78, so that a cycloidal path component is dispensed with and the fine machining adjustment is realized.

When in the fine machine adjustment the hollow gear 80 is rotatably driven from the rolling spur gear, the driver 26 and thereby the grinding plate unit 28 first of all performs a circular eccentric movement with a small, easily brakable part of central rotation, so that each grinding grain covers a small removal path. When the hollow gear 80 is arrested by the switching lever 52, or in other words its co-rotation is prevented, the spur gear 78 must positively roll on the stationary hollow gear 80. Therefore a not braking rotation is superposed on the circular movement of the grinding plate unit 28, so that each grinding grain covers a relatively great removal path, typically described as a cycloid, with characteristic coarse machining movement.

Figure 3:
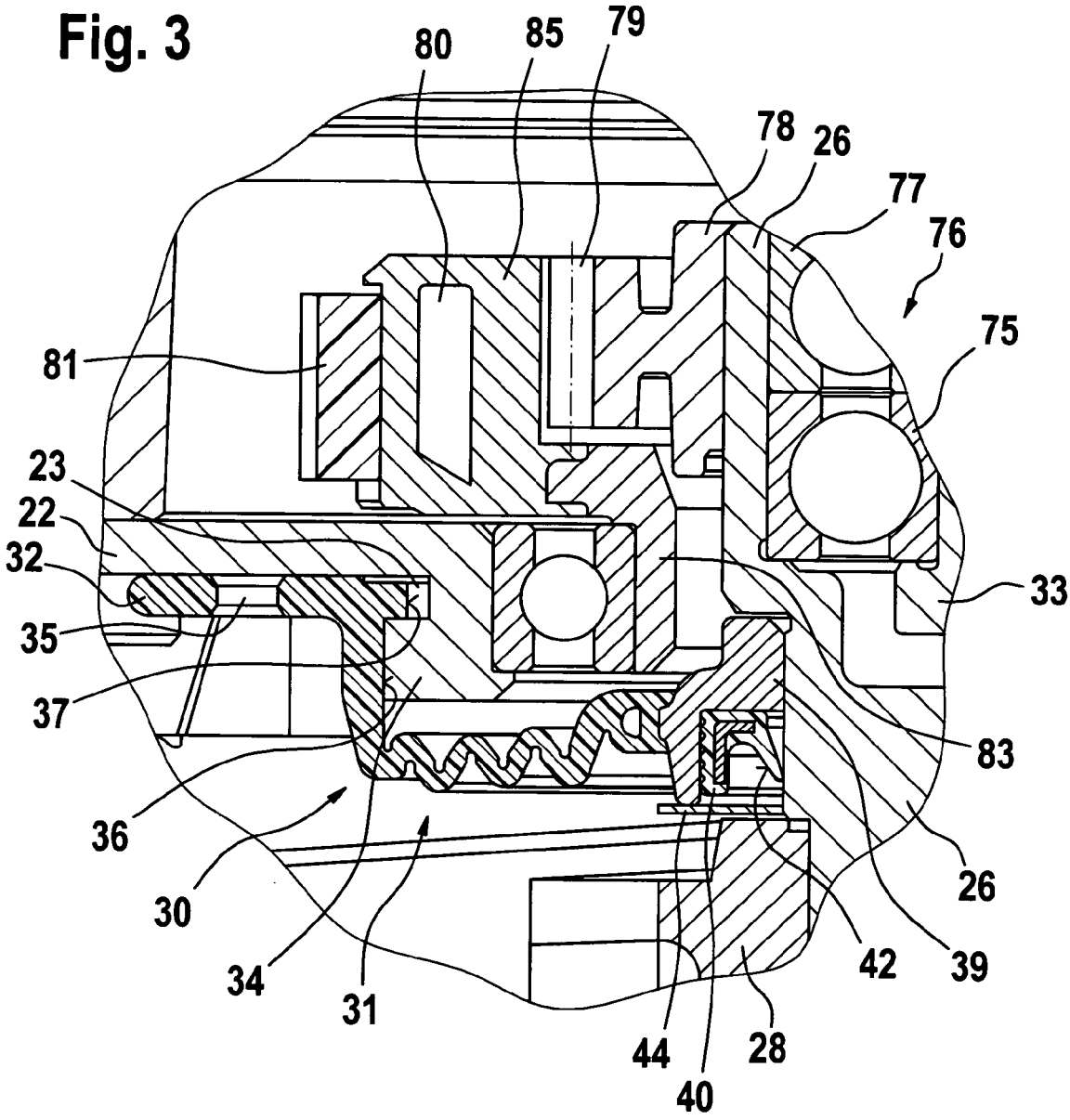
FIG. 3 is a view showing a fragment of FIG. 2 in the region of a transmission sealing element, in accordance with the present invention.

FIG. 3 shows a portion of a region between the driver 26 and the housing cover 22 on an enlarged scale, with a section of the part of the corrugated membrane 30. It can be seen how the outer rings 77 of the double roller bearings 76 are engaged outwardly in a ring-shaped manner by the stepped cylindrical driver 26, and it also forms a jointly rotating seat for the ring-shaped spur gear 78. The latter engages with its outer teeth 79 in the counter teeth on the inner rim 85 of the hollow gear 80, that is rotatably supported on the housing cover 22 through the roller bearing 82.

The arrangement of the corrugated membrane 30 is also shown here. It is held with its cup-shaped outer seat 36 outwardly radially in a form-locking or positive manner and axially in a force-transmitting or non-positive manner on a stepped collar 24 of the housing cover 22 and engages behind the collar 34 with several inwardly extending radial cams 37, that extend in the circumferential ring groove 23 and fix the corrugated membrane 30 with an additional form-locking connection. The outer edge 32 of the corrugated membrane 23 lies on it plainly and parallel to the outer side of the housing cover 22. The cup-shaped outer side 36 and the radial cam 37 form with the supporting surface of the housing cover 22, a labyrinth seal which prevents entry of grinding dust into the interior of the transmission housing 14.

From the seat collar 36 which is pre-stressed or stretched on the collar 34, draws the triple corrugated profile 31 to the central hole 38. It is composed of highly elastic, easily deformable, and in particular rubber-elastic synthetic plastic material. The edge of the central hole 38 supports an inner seat ring 39 of hard-elastic material which serves as a bearing seat for the radial shaft sealing ring 40. The radial shaft sealing ring 40 is supported slidingly and sealingly, with its inner ring wall 42, on the smooth outer wall of the driver 26. Its circular movement is performed during the operation of the eccentric grinder 10 inside of the central opening 24 of the housing cover 22. This circular movement must follow the shaft corrugated sealing ring 40, the inner seat ring 39 and the corrugated profile 31 of the corrugated membrane 30, for preventing penetration of grinding dust and other contaminants at the inlet into the interior of the transmission housing 14 or the bell 20 in each position of the driver 26.

Figure 4:
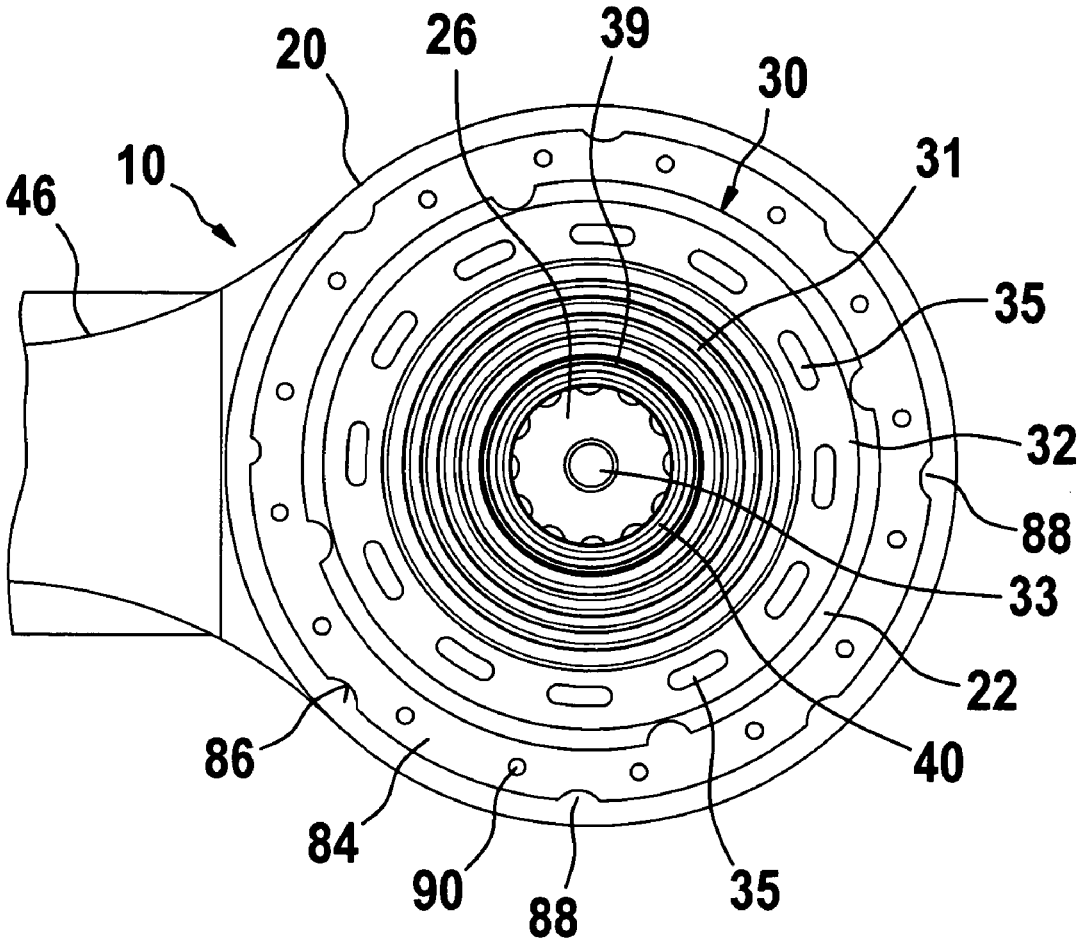
FIG. 4 is a plan view on the transmission seal of the hand power tool of FIG. 1.

The lower view of the transmission housing 14 of the eccentric grinder 10 shows in FIG. 4 the periphery of the bell 20 as well as the centrally arranged corrugated membrane 30 with the eccentrically deformed corrugated profile 31, that with the outer edge 32 formed as a collar plainly abuts against the housing cover 22. The concavely curved transition of the outer edge or the outer contour of the bell 20 into the suction pipe 45 provides for a low flow resistance of the passing suction air, that flows under the grinding plate unit 28 in FIG. 1 and passes it transversely between the upper side of the grinding plate unit 28 and the lower side of the bell 20 to its edge in the suction pipe 45 and is aspirated by it. Therefore the suction space for withdrawal of grinding dust through the suction pipe 45 is formed between the outer edge of the corrugated membrane 30 and the inner edge of an axial, rubber-elastic seal 84. It throttles the suction of foreign air but allows a lateral dust aspiration from the edge of the grinding plate unit 28.

Further, expansion holes 35 can be seen on the outer edge 32 of the corrugated membrane 30. They are elongated and spaced uniformly on the membrane, and allow the elastically stretching mounting of the corrugated diaphragm 30 on the collar 34. The eccentrically movable driver 26 is arranged centrally, in the center of the corrugated membrane 30 and surrounded by the radial shaft sealing ring 40, that is outwardly engaged and held by the inner seat ring 39.

Figure 5:
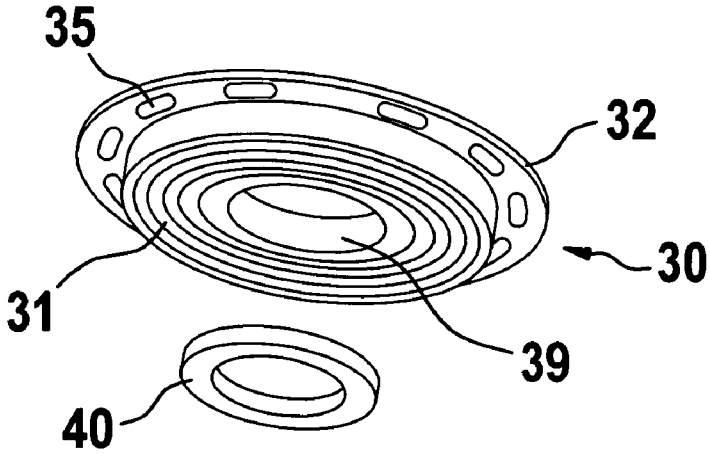
FIG. 5 is an explosion view of the transmission seal element of FIG. 4 in accordance with the present invention.

FIG. 5 shows a detail of the corrugated diaphragm 30 on an explosion view and spatially, together with the inner seat 29 and the radial shaft sealing ring 40 which is pressable into it axially.

Figure 6:
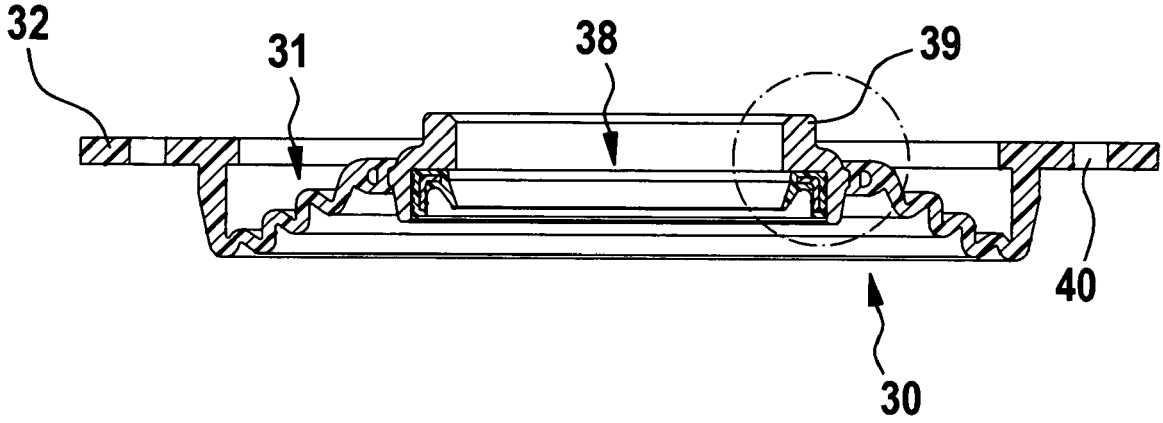
FIG. 6 is a view showing a cross-section of the transmission seal element in accordance with the present invention.

FIG. 6 shows a cross-section of the corrugated membrane 30 in a non-mounted condition as a unit, whose outer edge 32 with the stretching opening 35 as well as the shaft profile 31 that raises outwardly inwardly as a pyramid, is designed so that the inner seat ring 39 is axially pre-tensioned toward the driver 26. Thereby the inner seat ring 39 is supported with an axial collar surface 43 on a corresponding counter surface of the stepped cylindrical driver 26 and presses the corrugated membrane 30 in a flat shape.

The pyramid-shaped design of the corrugated membrane 30 prevents its sagging and presses the inner seat ring 39 axially with an average force against a projection of the driver 26 to prevent a wobbling of the inner seat ring 39.

Figure 7:
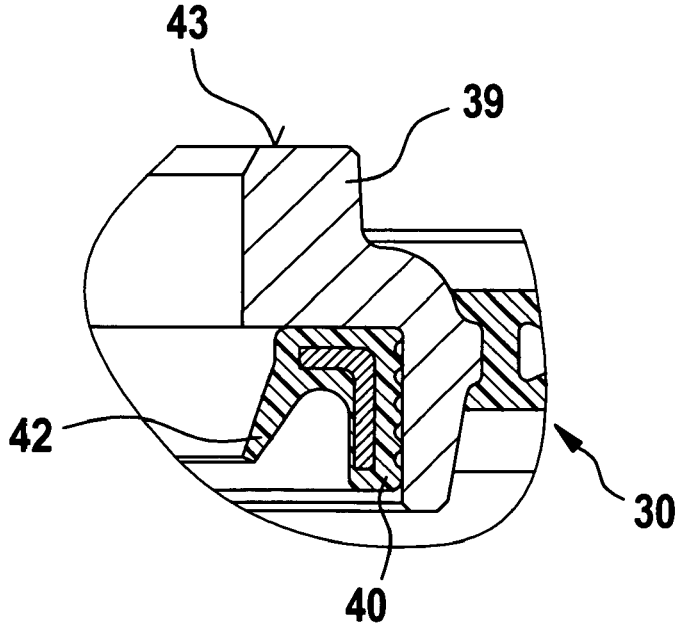
FIG. 7 is a view showing a fragment of the transmission seal element in accordance with the present invention.

FIG. 7 shows an enlarged view in the region of the corrugated diaphragm 30 with the inner seat ring 39. Its axial sealing surface 43 and the inserted radial shaft sealing ring 40 with its inner ring wall 42 steps out.

Figure 8:
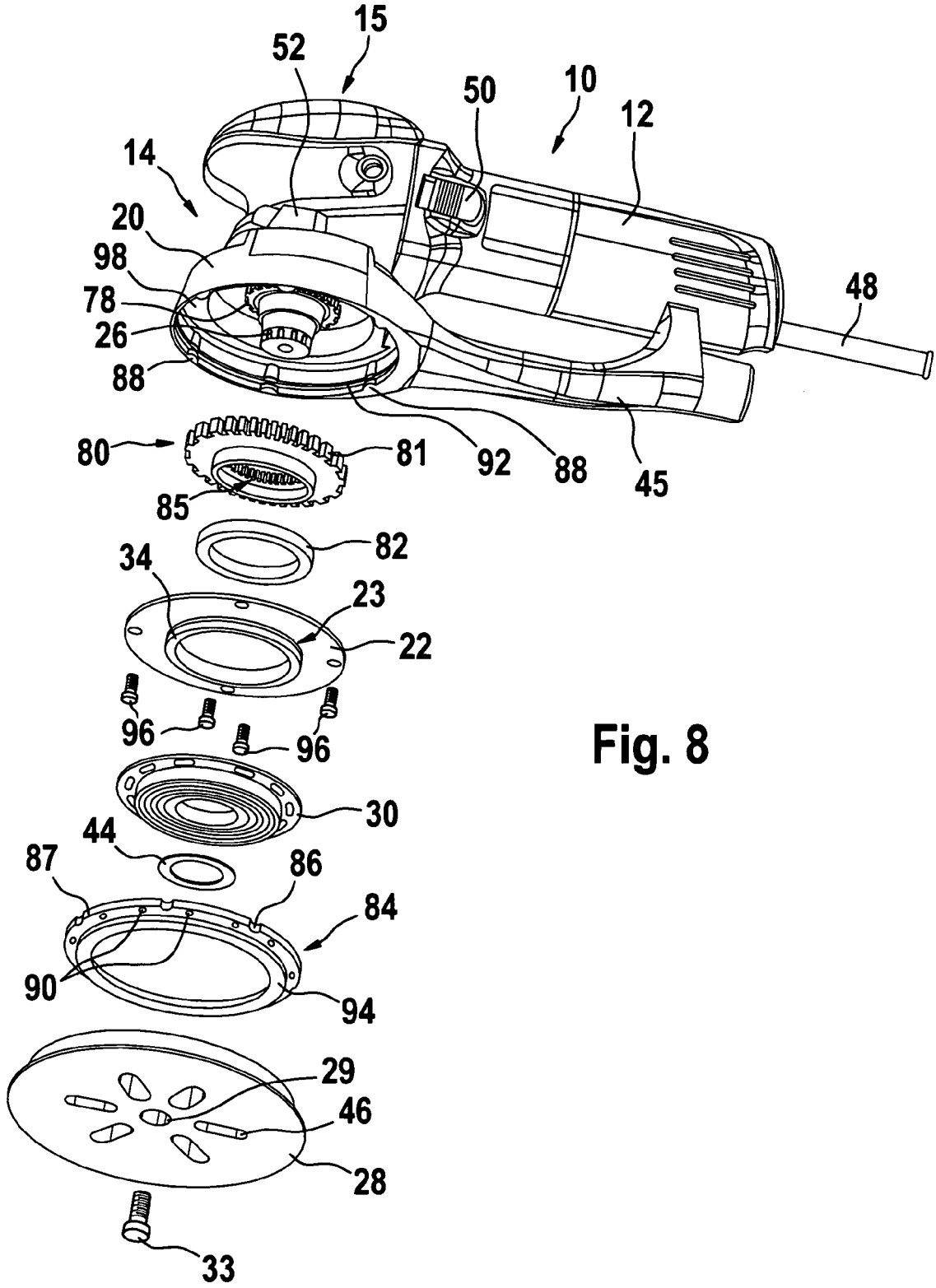
FIG. 8 is a partial view of the hand power tool with an explosion view of an eccentric transmission in accordance with the present invention.

The explosion view of FIG. 8 shows the eccentric grinder 10, wherein the parts extending beyond those shown in the previous drawings that do not have to be provided with complete references include the following emphasized details: The lateral inner view of the bell 20 of the transmission housing 14 shows the working position of the spur gear 78 arranged above the driver 26 and an arresting jaw 54 actuatable with the switching lever 52, which by abutment against the elastic outer rim 81 of the hollow gear 80 formed by a toothed belt, arrests it for joint rotation and stops its further rotation in the roller bearing 82. The housing cover 22 forms the bearing seat for the roller bearing 82 on the side facing the transmission housing 14. Therefore the hollow gear 80 sits with a downwardly extending collar 83 in the inner roller bearing 82 for joint rotation therewith and thereby also is carried by the housing cover 22. The pre-mounted assembly composed of the housing cover 22, the roller bearing 82 and the hollow gear 80 is guidable for mounting of the eccentric grinder 10 axially over the driver 26, wherein the hollow gear 80 is positionable engagingly with its inner rim 85 into a partial region of the spur gear 78, so that a continuous eccentric engagement of the spur gear 78 with outer teeth 79 in the inner rim 85 of the hollow gear 80 is secured.

As seen downwardly in the observation direction, the grinding plate unit 28 is shown axially being removed the farthest from the eccentric grinder 10. The corrugated membrane 30 is shown between the grinding plate unit 28 and the housing cover 22 axially spaced from one another, wherein also the sliding ring 40 that serves as a lubricant reservoir and the edge seal 84 are recognizable as an individual unit. The edge seal 84 is radially insertable with its outer edge 87 into an inner ring groove 92 of the interior of the bell 20 of the transmission housing 14 and thereby is positioned simultaneously axially secure, wherein semi-circular impressed depressions 36 in the outer edge of the edge seal 84 are form-lockingly or positively supported on the projections of the bell 20 formed by ribs 88, and hold the edge seal 84 for joint rotation.

An axially projecting sealing edge 94 of the edge seal 84 is oriented toward the upper side of the grinding plate unit 28 and is positioned with a minimal distance, so that a gap is formed. After connection of a vacuum cleaner to the suction pipe 45 it throttles a lateral entry of false air between the edge seal 84 and the grinding plate unit 28 and reduces it to an optimum.

The axial form-locking or positive connection between the grinding plate unit 28 and the driver 26 is provided by a not shown spline-shaft-like outer teeth of the driver 26 with the axially insertable or releasable engagement in a not shown, internal spline-shaped recess of the upper side of the grinding plate unit 28.

The edge seal 84 seals the space between the grinding plate unit and the bell 20 radially outwardly by a calculated gap between the sealing edge 94 and the upper side of the grinding plate 28, so that foreign air stream limits the negative pressure and the corrugated membrane 30 maintains its sealing functions and secure seat on the housing cover 22 with improved efficiency of the dust transportation in all working positions. Moreover, axial air openings 90 are arranged centrally in the edge of the edge seal. They additionally limit the negative pressure between the grinding plate unit 28 and the bell 20.

It will be understood that each of the elements described above, or two or more together, may also find a useful application in other types of constructions differing from the types described above.

While the invention has been illustrated and described as embodied in eccentric grinding hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. An eccentric grinding hand power tool, comprising a housing; a grinding plate unit supported on said housing and being eccentrically driven; an elastic seal that dust-tightly seals said housing with respect to said grinding plate unit, said elastic seal being held on said housing both in a form-locking positive manner and in a force-transmitting, non positive manner with integrated securing elements and without separate elements, wherein said elastic seal is formed as a corrugated membrane which on its outer edge has an axially extending seat collar, said seat collar having a shape and a size corresponding to a negative shape of at least one axial projection of a holding side of said housing and smaller dimension than said projection, so that said seat collar is pullable on said holding side only being stretched and is holdable on it automatically in a force-transmitting, non-positive manner.

2. An eccentric grinding hand power tool as defined in claim 1, wherein said corrugated membrane in a region of said seat collar has projections engageable in radial projections formed in a ring groove of a collar of said holding side in a housing cover.

3. An eccentric grinding hand power tool, comprising a housing; a grinding plate unit supported on said housing and being eccentrically driven; an elastic seal that dust-tightly seals said housing with respect to said grinding plate unit, said elastic seal being held on said housing both in a form-locking positive manner and in a force-transmitting, non positive manner with integrated securing elements and without separate elements, wherein said elastic seal is formed as a corrugated membrane composed of a soft elastic material and on its outer edge is provided with elongated stretching openings arranged in uniform distances, for increasing an elasticity of said corrugated membrane in a region of its seat collar.

4. An eccentric grinding hand power tool as defined in claim 1, wherein said elastic seal is formed as a corrugated membrane having a central hole with an edge; and further comprising a hard-elastic inner seat ring supported on said edge and forming an inner seat of a radial corrugated sealing ring.

5. An eccentric grinding hand power tool as defined in claim 1; and further comprising a housing cover which covers said housing from below and has a side that faces said grinding plate unit and carries a corrugated membrane that forms said seal said grinding plate unit having an eccentric transmission with parts mounted on a side of said housing cover which faces an angle transmission.

6. An eccentric grinding hand power tool as defined in claim 1; and further comprising an edge seal which covers and intermediate space between said grinding plate unit and said bell with a predetermined gap for limiting a negative pressure in the intermediate space, radially outwardly, said edge seal being elastic and engaging in a form-locking, positive manner into an inner ring groove of said bell.

7. An eccentric grinding hand power tool as defined in claim 6, wherein said edge seal has a sealing edge which faces axially toward an upper side of said grinding plate unit and forms said predetermined gap.

8. An eccentric grinding hand power tool as defined in claim 7, wherein said edge seal has air openings which are uniformly spaced from one another and operating for limiting a negative pressure in said intermediate space.

* * * * *